United States Patent [19]

Sasaki et al.

[11] Patent Number: 4,923,794

[45] Date of Patent: May 8, 1990

[54] SILVER HALIDE PHOTOGRAPHIC MATERIALS

[75] Inventors: Hirotomo Sasaki; Tadao Shishido; Hiroyuki Mifune, all of Kanagawa, Japan

[73] Assignee: Fuji Photo Film Co., Ltd., Kanagawa, Japan

[21] Appl. No.: 378,100

[22] Filed: Jul. 11, 1989

[30] Foreign Application Priority Data

Jul. 12, 1988 [JP] Japan ..... 63-173474

[51] Int. Cl.[5] ..... G03C 1/08

[52] U.S. Cl. ..... 430/603; 430/569

[58] Field of Search ..... 430/603, 607, 569

[56] References Cited

U.S. PATENT DOCUMENTS

| | | | |
|---|---|---|---|
| 1,623,499 | 6/1925 | Sheppard et al. | 430/603 |
| 4,035,185 | 7/1977 | Evans et al. | 430/569 |
| 4,607,000 | 8/1986 | Gunther et al. | 430/607 |

FOREIGN PATENT DOCUMENTS 53-57817 5/1978 Japan .

*Primary Examiner*—Paul R. Michl

*Assistant Examiner*—Thomas R. Neville

*Attorney, Agent, or Firm*—Sughrue, Mion, Zinn, Macpeak & Seas

[57] ABSTRACT

A silver halide photographic material comprising silver halide emulsion including a telluroether compound of the formula (I):

$$L_1—Te—L_2 \quad (I)$$

wherein $L_1$ and $L_2$ each independently represents a substituted or unsubstituted aliphatic group which is substituted with at least one hydroxyl group, mercapto group, amino group, ether group, selenoether group, thioether group, ammonium group, sulfonyl group, carbamoyl group, carbonamido group, sulfamoyl group, sulfonamido group, acyloxy group, sulfonyloxy group, ureido group, thioureido group, thioamido group, oxysulfonyl group, oxycarbonylamino group, sulfonic acid group or salt thereof, phosphoric acid or salt thereof, phosphoric ester group, sulfinic acid group or a salt thereof, phosphino group or heterocyclic group.

17 Claims, No Drawings

SILVER HALIDE PHOTOGRAPHIC MATERIALS

FIELD OF THE INVENTION

This invention concerns silver halide photographic materials and, more precisely, it concerns silver halide photographic materials which contain novel telluroether compounds.

BACKGROUND OF THE INVENTION

Much effort has been directed in the past towards the provision of silver halide photographic materials which have a high photographic sensitivity, which produce little fog, and with which the change in photographic characteristics with the passage of time on storage is slight.

For example, organic thioether compounds have long been used as silver halide solvents or chemical sensitizing agents in the manufacture of silver halide photographic emulsions for increasing photographic sensitivity.

For example, techniques for the manufacture of so-called monodispersed silver halide photographic emulsions which have a uniform silver halide grain size by including organic thioether compounds during the precipitation or physical ripening processes in the manufacture of the silver halide photographic emulsions (referred to hereinafter simply as emulsions) have been described, for example, in U.S. Pat. Nos. 3,271,157, 3,531,289, 3,574,628 and 4,057,429.

Furthermore, techniques for increasing the photographic sensitivity of emulsions by including organic sulfur compounds during chemical ripening during the preparation of the emulsion or immediately prior to coating have been described, for example, in U.S. Pat. Nos. 2,521,926, 3,021,215, 3,038,805, 3,506,443, 3,057,724, 3,062,646, 3,574,709, 3,622,329 and 3,625,697.

Furthermore, a technique for raising the photographic sensitivity of emulsions using tellurium compounds which contain a tellurium atom, preferably substituted on an aromatic ring, such as bis(p-ethoxyphenyl)telluride, during the formation of silver halide grains has been disclosed in No. JP-A-53-57817 (the term "JP-A" as used herein refers to a "published unexamined Japanese patent application").

However, there is a tendency towards increased fogging when organic thioether compounds are included during the preparation of an emulsion.

Techniques such as carrying out the precipitation at a pH value of less than 4, or using highly refined organic thioether compounds are known for preventing the fogging which arises when organic thioethers are used, but these results are often unsatisfactory and there is a further problem in that such techniques are not practical on an industrial scale.

Furthermore, thioether compounds which may be used in combination with certain specified antifogging agents, as disclosed in No. JP-B-58-27489, and thioether compounds such as those disclosed in No. JP-B-58-30571 have been developed, and the development of compounds which give rise to less fogging and with which high sensitivity could be achieved was anticipated, but these objectives have not yet been realized with thioether compounds (the term "JP-B" as used herein refers to an "examined Japanese patent publication").

Furthermore, the organic telluroether compounds disclosed in No. JP-A-53-57817 certainly have a sensitivity raising action but, as shown in the examples, the effect is inadequate and there is a marked deterioration in photographic characteristics in respect of photographic sensitivity and gradation, for example, with the passage of time on storage.

SUMMARY OF THE INVENTION

Thus, the first object of the invention is to provide emulsions with which there is no increase in fogging even when the photographic sensitivity is increased.

The second object of the invention is to provide high sensitivity silver halide photographic materials which show little deterioration in photographic characteristics with the passage of time on storage.

The third object of the invention is to provide silver halide photographic materials which are suitable for rapid development processing, which have a high photographic sensitivity and with which little fog is produced.

The objects of the invention have been realized by means of silver halide photographic materials which contain at least one telluroether compound represented by the general formula (I) indicated below.

$$L_1—Te—L_2 \qquad (I)$$

wherein $L_1$ and $L_2$ each independently represents a substituted or unsubstituted aliphatic group, and at least one of $L_1$ or $L_2$ represents an aliphatic group which is substituted with at least one hydroxyl group, mercapto group, amino group, ether group, thioether group, selenoether group, ammonium group, sulfonyl group, carbamoyl group, carbonamido group, sulfamoyl group, sulfonamido group, acyloxy group, sulfonyloxy group, ureido group, thioureido group, oxysulfonyl group, thioamido group, oxycarbonylamino group, sulfonic acid group or salt thereof, phosphoric acid or salt thereof, phosphoric ester group, sulfinic acid group or a salt thereof, phosphino group or heterocyclic group. The salts of sulfonic acid, sulfinic acid and phosphoric acid may include a sodium salt, a potassium salt and an ammonium salt, respectively.

DETAILED DESCRIPTION OF THE INVENTION

General formula (I) is described in detail below.

The aliphatic groups represented by $L_1$ and $L_2$ in general formula (I) are linear chain or branched alkyl groups, linear chain or branched alkenyl groups or cycloalkyl groups.

The linear chain or branched alkyl groups have from 1 to 30, and preferably from 1 to 20, carbon atoms (for example, methyl, ethyl, propyl, n-butyl, sec-butyl, t-butyl, n-hexyl, 2-ethylhexyl, n-octyl, t-octyl, n-dodecyl, n-hexadecyl, n-octadecyl, isostearyl or eicosyl).

The linear chain or branched alkenyl groups have from 2 to 30, and preferably from 2 to 20, carbon atoms (for example, allyl, butenyl, propenyl, octenyl, dodecenyl or oleyl).

The cycloalkyl groups have from 3 to 12-membered, and preferably from 5 to 7-membered, rings (for example, cyclopropyl, cyclopentyl, cyclohexyl, cycloheptyl or cyclododecyl).

Alkyl groups and alkenyl groups are preferred as the aliphatic groups represented by $L_1$ and $L_2$, and the alkyl groups are the most preferred.

At least one of the aliphatic groups represented by $L_1$ and $L_2$ must have at least one substituent group. In cases where there are two or more substituent groups may be the same or different. The substituent groups may be amino groups (including salts, for unsubstituted amino, dimethylamino, diethylamino, dimethylamino hydrochloride, hydroxyethylamino), ether groups (for example, methoxy, phenoxy), thioether groups (for example, methylthio, phenylthio), selenoether groups (for example, methylseleno, phenylseleno), ammonium groups (for example, trimethylammonium), hydroxyl groups, mercapto groups, sulfonyl groups (for example, methanesulfonyl, ethanesulfonyl, p-toluenesulfonyl), carbamoyl groups (for example, unsubstituted carbamoyl, methylcarbamoyl, phenylcarbamoyl), sulfamoyl groups (for example, unsubstituted sulfamoyl, methylsulfamoyl, phenylsulfamoyl), carbonamido groups (for example, acetamido, benzamido), sulfonamido groups (for example, methanesulfonamido, benzenesulfonamido, p-toluenesulfonamido), acyloxy groups (for example, acetyloxy, benzoyloxy), sulfonyloxy groups (for example, methanesulfonyloxy), ureido groups (for example, unsubstituted ureido, methylureido, ethylureido, phenylureido), thioureido groups (for example, unsubstituted thioureido, methylthioureido), oxycarbonylamino groups (for example, methoxycarbonylamino, phenoxycarbonylamino, 2-ethylhexyloxycarbonylamino), oxysulfonyl groups (for example, methoxysulfonyl), sulfonic acid groups and salts thereof (for example, sodium sulfonate), phosphoric acid groups and salts thereof (for example, —OPO(OH)ONa), phosphoric ester groups (for example, —OPO$(OCH_3)_2$), sulfinic acid groups and salts thereof (for example, sodium sulfinate), phosphino groups (for example, diphenylphosphino), thioamido groups and heterocyclic groups (for example, 1-morpholino, 1-piperidino, 2-pyridyl, 4-pyridyl, 2-thienyl, 1-pyrazolyl, 1-imidazolyl, 2-imidazolyl, 4- or 5-imidazolyl, 2-tetrahydrofuryl, 2-tetrahydrothienyl, benzotriazolyl, benzoxazolyl, benzothiazolyl, thiazolyl, oxazolyl, triazolyl, tetrazolyl, tetraazaindenyl, triazaindenyl, diazaindenyl, indolyl).

Amino groups, ether groups, thioether groups, selenoether groups, ammonium groups, hydroxyl groups, mercapto groups, sulfonyl groups, carbamoyl groups, carbonamido groups, sulfamoyl groups, sulfonamido groups, ureido groups, thioureido groups, oxycarbonylamido groups, thioamido groups, sulfonic acid groups or salts thereof, sulfinic acid groups or salts thereof, phosphoric acid groups or salts thereof, phosphino groups and heterocyclic groups are preferred from among these substituent groups. Hydroxyl groups, amino groups, sulfonic acid groups and salts thereof, and thioether groups are more preferred and hydroxyl groups are the most preferred of these groups.

Actual examples of compounds which can be represented by the general formula (I) of this invention are indicated below, but the compounds of this invention are not limited to these examples.

$HOCH_2CH_2TeCH_2CH_2OH$ 1

$HOCH_2CH_2CH_2Te—(CH_2)_4—OH$ 2

$HOCH_2CH_2CH_2TeCH_2CH(OH)CH_2OH$ 3

-continued $HOCH_2CH(OH)CH_2TeCH_2CH_2CH_2CH_3$ 4

$HOCH_2CH_2TeCH_2CH_2OCH_3$ 5

$HOCH_2CH_2TeCH_2CH_2CH_2SCH_3$ 6

$HOCH_2CH_2TeCH_2CH_2CH_2SCH_2CH_2OH$ 7

$HOCH_2CH_2TeCH_2CH_2CH_2NH_2$ 8

$H_2NCH_2CH_2CH_2TeCH_2CH_2N(H)CH_2CH_2SCH_3$ 9

$HOCH_2CH_2TeCH_2CH_2CH_2SO_3H$ 10

$H_2N(C=O)CH_2CH_2CH_2TeCH_2CH_2CH_2N(H)(C=O)CH_3$ 11

$H_2NSO_2CH_2CH_2CH_2TeCH_2CH_2CH_2N(H)SO_2C_2H_5$ 12

$HOCH_2CH_2TeCH_2CH_2CH_2SO_2H$ 13

$H_2NCH_2CH_2CH_2TeCH_2CH_2CH_2N(H)(C=O)NHCH_3$ 14

$H_2NCH_2CH_2TeCH_2CH_2CH_2N(H)(C=S)NHCH_3$ 15

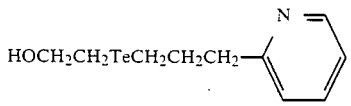

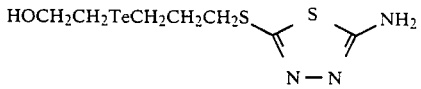

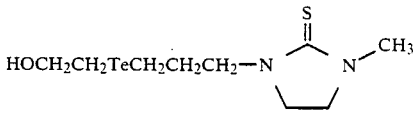

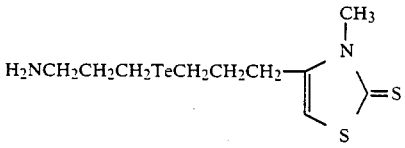

$HOCH_2CH(OH)CH_2TeCH_2CH_2CH_2CH_2P(C_6H_5)_2$ 20

$HOCH_2CH=CHCH_2TeCH_2CH_2CH=CHCH_2OH$ 21

$HOCH_2CH=CH—Te—CH=CHCH_2OH$ 22

$HOCH_2CH=CH—TeCH_2CH_2CH_2SO_3H$ 23

$H_2N(C=S)CH_2CH_2CH_2TeCH_2CH_2CH_2N(H)(C=S)CH_3$ 24

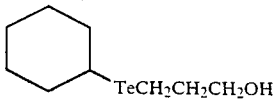

25

$HOCH_2CH_2OCH_2CH_2TeCH_2CH_2OH$ 26

-continued

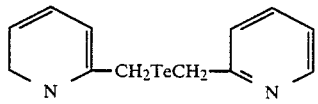

The telluroether compounds (diorganotellurides) used in the invention can be prepared, in general, using the known methods in which sodium telluride or tellurole is reacted with the corresponding organic halide. Examples of such procedures have been described, for example, in *Inorganic Chemistry,* Vol. 18, pages 2696 to 2700 (1979) and in *Journal of Medicinal Chemistry,* Vol. 26, pages 1293 to 1300 (1983). The compounds used in this invention are easily prepared in accordance with these methods.

An example of the synthesis of a typical compound is illustrated below.

SYNTHESIS EXAMPLE

Preparation of Illustrative Compound 1

Metallic tellurium powder (200 mesh, 25.4 g, 0.2 mol) was dispersed in 600 ml of distilled water under an argon atmosphere and in yellow light and heated to 80° C. A solution obtained by dissolving 20 g (0.53 mol) of sodium borohydride ($NaBH_4$) in 200 ml of water was added with stirring. The mixture effervesced vigorously and turned violet in color, after which it became a homogeneous and colorless solution. The mixture was then cooled to room temperature, after which 2-bromoethanol (28.4 ml, 0.4 mol) which had been dissolved in 75 ml of a mixture of THF (tetrahydrofuran) and methanol was added and the mixture was reacted for a period of 1 hour. The reaction mixture was then poured into about 1 liter of water and extracted with diethyl ether. The extract was dried over magnesium sulfate, after which the magnesium sulfate was removed by filtration and the diethyl ether was removed by distillation and about 25 g of an oily product was obtained. This was refined using silica gel column chromatography whereupon 9.5 g of the desired compound was obtained in the form of an orange oil (yield: 22%). The structure of the desired compound was determined using nuclear magnetic resonance spectroscopy, mass spectrometry and elemental analysis.

The organic telluroether compounds of this invention have a greater effect on increasing photographic sensitivity than the tellurium compounds disclosed in No. JP-A-53-57817 as described earlier. Moreover, the change in photographic sensitivity which arises on solution aging, which is to say when the solution time of the emulsion immediately prior to coating on the support is somewhat prolonged, is slight, and there is a further major advantage here in that the deterioration in photographic characteristics of the coated photosensitive material with the passage of time on storage is also slight.

In this invention, the organic telluroether compounds are preferably added in at least one of the processes selected from among the precipitation and formation of the silver halide grains and the subsequent physical ripening and chemical ripening processes, or immediately before coating. Addition of these compounds during the precipitation and formation of the silver halide grains, during physical ripening or during chemical ripening is especially desirable.

In this invention, the silver halide grains can be prepared by any of the general methods well known in the industry, but use of the double jet method is especially desirable.

The double jet method is a method of preparation in which an aqueous solution of silver nitrate and an aqueous solution which contains at least one type of halide (for example, an alkali metal halide such as potassium bromide) are added simultaneously using two separate jets to a stirred solution of a protective colloid (for example, gelatin or a gelatin derivative) to form the silver halide.

In this invention, the addition of the organic telluroether compound to the protective colloid solution before starting the precipitation is preferred in the case of an addition which is made during the precipitation and formation and/or physical ripening of the silver halide, but it can be added to the protective colloid during precipitation via the jet used for the addition of the aforementioned halide and/or the jet used for adding the silver nitrate, or it may be added via a separate jet.

The photographic emulsions in this invention can be prepared using the methods described, for example, in *Chemie et Physique Photographique,* by P. Glafkides, published by Paul Montel, 1967; *Photographic Emulsion Chemistry,* by G. F. Duffin, published by Focal Press, 1966; and *Making and Coating Photographic Emulsions,* by V. L. Zelikman et al., published by Focal Press, 1964. That is to say, they can be prepared using any of the acidic methods, neutral method and ammonia methods, for example, and the system used for reacting the soluble silver salt with the soluble halide may take the form of a single jet-mixing method, a double jet-mixing method or a combination of these methods.

The methods in which the grains are formed in the presence of excess silver ion (the so-called reverse mixing methods) can also be used.

Furthermore, the grain size distribution of the silver halide grains in the photographic emulsion is optional, but monodispersion are preferred. Here, a monodispersion is a dispersion in which 95% of the grains are of a size within ±60%, and preferably within ±40%, of the number average grain size. Moreover, the number average grain size referred to herein is the number average diameter of the projected area diameters of the silver halide grains.

Mixtures of two or more types of silver halide emulsions which have been prepared separately can also be used.

The silver halide used in an emulsion in this invention may be silver bromide, silver iodobromide, silver iodochlorobromide, silver chlorobromide, silver iodide or silver chloride.

The grain size distribution may be narrow or wide.

The silver halide grains in the photographic emulsion may have a regular crystalline form, such as a cubic, octahedral, tetradecahedral or a rhombohedral form, or they may have an irregular crystalline form, such as a spherical or plate-like form, or they may have a crystalline form which is a composite of these crystalline forms.

The emulsions can also be formed from mixtures of grains which have various crystalline forms.

They may also consist of crystals which have high order index planes.

The silver halide grains may have different phases for the interior part and the surface layer, or they may consist of a uniform phase. The grains may also have a double structure or a multiple structure.

Furthermore, the grains may consist of junction type silver halide crystals in which, for example, a silver halide such as silver chloride is bonded to an oxide crystal such as lead oxide, or silver halide crystals which have been grown epitaxially (for example, crystals in which silver chloride, silver iodobromide or silver iodide, for example, has been grown epitaxially on silver bromide), or hexagonal crystal forms or of a crystal form in which a regular hexagonal silver chloride is arranged in a complex manner on silver iodide.

Furthermore, tabular silver halide grains which have an aspect ratio of at least 3, and preferably of from 5 to 20, can also be used. These have been described in more detail, for example, in U.S. Pat. Nos. 4,434,226 and 4,439,520, European Patent Nos. 84,637A2, No. JP-A-59-99433 and *Research Disclosure,* Vol. 225, No. 2534 (January, 1983).

Furthermore, silver halide grains can be formed using the methods disclosed in Japanese Patent Application Nos. 63-7851, 63-7852 and 63-7853.

No particular limitation is imposed upon the conditions such as the pH value, the pAg value and the temperature, for example, during the formation of the silver halide grains in this invention, but the pH value is preferably maintained between about 1 and about 10, and most desirably between 2 and 8, and the pAg value is preferably maintained between about 5 and about 11, and most desirably between 7.8 and 10.5.

In respect of temperature, the silver halide grains can be formed at any temperature between about 30° C. and about 90° C., but formation at a temperature between 35° C. and 80° C. is preferred.

Of course, the pH and pAg values, and the temperature, can be varied during the formation of the silver halide grains.

Cadmium salts, zinc salts, lead salts, thallium salts, iridium salts or complex salts thereof, rhodium salts or complex salts thereof, and iron salts or complex salts thereof may be included during the formation and physical ripening of the silver halide grains. The amounts added may be small or large, depending on the intended purpose of the photosensitive material.

The amount of the organic telluroether compounds of this invention which can be added during the formation of the silver halide grains is from 0.001 to 100 g per mol of silver halide, but the addition of from 0.003 to 30 g per mol of silver halide is preferred while the addition of from 0.01 to 10 g per mol of silver halide is most preferred.

Furthermore, the telluroether compounds of this invention can be used in combination with the known thioether compounds mentioned earlier, ammonia, thiocyanates (for example, potassium thiocyanate) and with the compounds disclosed, for example, in Nos. JP-B-58-51252, JP-A-55-77737, U.S. Pat. No. 4,221,863 and No. JP-B-60-11341.

Furthermore, in cases where the organic telluroether compounds of this invention are used prior to chemical ripening (for example, during the formation of the silver halide grains) their function as silver halide solvents can be deactivated using the method disclosed in No. JP-A-60-136736.

As mentioned earlier, the organic telluroether compounds can also be added during the chemical ripening process in this invention. In this case the amount of organic telluroether compound added is from 0.001 to 10 g, and preferably from 0.003 to 1 g, per mol of silver halide.

No particular limitation is imposed on the conditions, for example, the pH value, pAg value, temperature and time, or on the additives used, for the chemical ripening process in this invention, and the process can be carried out under the conditions generally used in the industry.

For example, the pH value can be from 3.0 to 8.5, and preferably from 5.0 to 7.5, the pAg value can be from 7.0 to 9.5, and preferably from 8.0 to 9.3, the temperature can be from 40° C. to 85° C., and preferably from 45° C. to 75° C., and the time can be from 5 to 200 minutes, and preferably from 10 to 120 minutes.

Furthermore, as mentioned earlier, the organic telluroether compounds can also be added in the process immediately prior to coating, and the amount added in this case is from 0.001 to 10 g, and preferably from 0.003 to 5 g, per mol of silver halide.

The noodle washing method which is carried out by gelling the gelatin can be used to remove the soluble salts from the emulsion after the precipitation and formation or after the physical ripening of the silver halide grains, or precipitation methods (flocculation methods) using inorganic salts, anionic surfactants, anionic polymers (for example, poly(styrenesulfonic acid) or gelatin derivatives (for example, acylated gelatin or carbamoylated gelatin) can be used for this purpose.

The silver halide emulsions are usually subjected to chemical sensitization. The methods described in *Die Grundlagen der Photographischen Prozesse mit Silberhalogeniden,* pages 675 to 734, edited by H. Frieser and published by Akademische Verlagsgesellschaft (1968) can be used, for example, for chemical sensitization. That is to say, sulfur sensitization methods using active gelatin or compounds which contain sulfur which can react with silver ions, selenium sensitization methods, reduction sensitization methods using reducing substances, and noble metal sensitization methods using gold or other noble metal compounds can be used singly or in combination for this purpose. Thiosulfates, thioureas, thiazoles, rhodanines and other compounds can be used as sulfur sensitizing agents.

Stannous salts, amines, hydrazine derivatives, formamidinesulfinic acid and silane compounds, for example, can be used as reduction sensitizing agents. Complex salts of the metals of group VIII of the Periodic Table, such as platinum, iridium and palladium, for example, can be used as well as gold complex salts such as chloroauric acid and dithiocyanatogold salts, for example, for noble metal sensitization.

The use of sensitization with noble metals such as gold compounds and sensitization with sulfur compounds is especially desirable.

Furthermore, polyalkylene oxides or ether, ester or amine derivatives thereof, thioether compounds, thiomorpholines, quaternary ammonium salt compounds, urethane derivatives, urea derivatives, imidazole derivatives and 3-pyrazolidones, for example, may be included with a view to increasing sensitivity, increasing contrast or accelerating development. Use can be made of those disclosed, for example, in U.S. Pat. Nos. 2,400,532, 2,423,549, 2,716,062, 3,617,280, 3,772,021 and 3,808,003.

Various compounds can be included in the photographic emulsions which are used in the invention with a view to preventing the occurrence of fogging during the manufacture, storage or photographic processing of the photosensitive material, or with a view to stabilizing photographic characteristics. Thus, many compounds which are known as antifogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (especially 1-phenyl-5-mercaptotetrazole); mercaptopyrimidines; mercaptotriazines; thioketo compounds such as, for example, oxazolinethione; azaindenes, for example, triazaindenes, tetraazaindenes (especially 4-hydroxy substituted (1,3,3a,7)tetraazaindene) and pentaazaindenes; benzenesulfinic acid, benzenesulfonic acid amide and benzenethiosulfonic acid can be added for this purpose.

The use of gelatin is convenient for the binding agent or protective colloid which is used in the photosensitive material, but hydrophilic synthetic polymers can also be used for this purpose. Lime-treated gelatins, acid-treated gelatins and gelatin derivatives, for example, can be used for the gelatin.

Furthermore, in the invention a variety of known surfactants can be included in the photographic emulsion layers or other hydrophilic colloid layers for various purposes, for example, as coating aids, as antistatic agents, as lubricants, for emulsification and dispersion purposes, for preventing adhesion and for improving photographic characteristics (for accelerating development, increasing contrast or increasing sensitivity, for example).

The photographic emulsions of this invention may be spectrally sensitized with methine dyes or by other means. Cyanine dyes, merocyanine dyes, complex cyanine dyes, complex merocyanine dyes, holopolar cyanine dyes, hemicyanine dyes, styryl dyes and hemioxonol dyes are included among the dyes which can be used for this purpose. Dyes from among the cyanine dyes, merocyanine dyes and complex merocyanine dyes are especially useful. Any of the nuclei normally used in cyanine dyes can be used as the basic heterocyclic nucleus in these dyes. That is to say, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus, a nucleus obtained by fusing an aliphatic hydrocarbon ring with these nuclei, or a nucleus obtained by fusing an aromatic hydrocarbon ring with these nuclei, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, can be used for this purpose. These nuclei may be substituted on their carbon atoms.

5- or 6-membered heterocyclic nuclei, such as a pyrazolin-5-one nucleus, a thiohydantoin nucleus, a 2-thiooxazolidin-2,4-dione nucleus, a thiazolidin-2,4-dione nucleus, a rhodanine nucleus or a thiobarbituric acid nucleus, can be used as the nucleus which has a ketomethylene structure in the merocyanine dyes and complex merocyanine dyes.

Dye-forming couplers, which is to say, compounds (referred to hereinafter as couplers) which form dyes on reacting with the oxidation products of aromatic amine (normally primary amine) developing agents can be used in photographic emulsions of this invention. The couplers are preferably rendered fast to diffusion by having hydrophobic groups known as ballast groups within the molecule. The couplers may be either 4-equivalent or 2-equivalent with respect to silver ion. Colored couplers which have a color correcting effect, or couplers (so-called DIR couplers) which release development inhibitors as development proceeds can also be included. The couplers may also be of the type of which the products of the coupling reaction are themselves colorless.

The known open chain ketomethylene-based couplers can be used as yellow color-forming couplers. Among these, the benzoylacetanilide-based compounds and pivaloylacetanilide-based compounds are useful.

Pyrazolone-based compounds, indazolone-based compounds and cyanoacetyl compounds, for example, can be used as magenta couplers, and the pyrazolone-based compounds are especially useful.

Phenol-based compounds and naphthol-based compounds can be used as cyan couplers.

Compounds other than DIR couplers which release development inhibitors as development proceeds can be included in the photosensitive materials, and the compounds disclosed, for example, in U.S. Pat. Nos. 3,297,445 and 3,379,529, and West German Patent Application (OLS) No. 2,417,914, can be used for this purpose.

Two or more of the coupler types described above can be used in the same layer. The same compound can also be used in two or more different layers.

The known methods, such as those disclosed in U.S. Pat. No. 2,322,027, for example, can be used to introduce the couplers into a silver halide emulsion layer.

The silver halide emulsions used have normally been subjected to physical ripening, chemical ripening and spectral sensitization. Additives which can be used in such processes have been disclosed in *Research Disclosure*, Nos. 17643 (Vol. 176) (December, 1978) and 18716 (Vol. 187) (November, 1979), and the locations of these disclosures are summarized in the table below.

Known photographically useful additives which can be used conjointly in this invention are also disclosed in the two *Research Disclosures* mentioned above, and the locations of these disclosures are also shown in the table below.

| Type of Additive | RD 17643 | RD 18716 |
|---|---|---|
| 1. Chemical Sensitizers | Page 23 | Page 648, right column |
| 2. Sensitivity Increasing Agents | — | " |
| 3. Spectral Sensitizers | Pages 23–24 | Page 648, right column to page 649, right column |
| 4. Supersensitizers | " | Page 648, right column to page 649, right column |
| 5. Whiteners | Page 24 | — |
| 6. Antifoggants and Stabilizers | Pages 24–25 | Page 649, right column |
| 7. Couplers | Page 25 | Page 650, left column |
| 8. Organic Solvents | Page 25 | — |
| 9. Light Absorbers, Filter Dyes | Pages 25–26 | Page 649, right column to page 650, left column |
| 10. Ultraviolet Absorbers | Page 26 | Page 650, left column |
| 11. Antistaining Agents | Page 25, right column | Page 650, left to right columns |
| 12. Dye Image Stabilizers | Page 25 | — |
| 13. Film Hardening Agents | Page 26 | Page 651, left column |
| 14. Binders | Page 26 | " |

-continued

| Type of Additive | RD 17643 | RD 18716 |
|---|---|---|
| 15. Plasticizers, Lubricants | Page 27 | Page 650, right column |
| 16. Coating Aids, Surfactants | Pages 26–27 | " |
| 17. Antistatic Agents | Page 27 | " |

Silver halide emulsions of this invention can be used in black-and-white silver halide photographic materials (for example, X-ray films, lith materials, and black-and-white camera negative films, etc.) and in color photographic materials (for example, color negative films, color reversal films, color papers, etc.). Moreover, they can also be used in diffusion transfer type photosensitive materials (for example, color diffusion transfer elements and silver salt diffusion transfer elements) and in thermally developable photosensitive materials (black-and-white and color materials), etc.

The photographic emulsions of this invention can be coated by dip coating, roller coating, curtain coating or extrusion coating, for example, onto the flexible supports such as plastic films and papers, and rigid supports such as glass, which are normally used for photographic materials. Films made from semisynthetic or synthetic polymeric materials, such as cellulose nitrate, cellulose acetate, cellulose acetate butyrate, polystyrene, poly(vinyl chloride), polyethylene terephthalate or polycarbonate, and papers which have been coated or laminated with a baryta layer or an α-olefin polymer (for example, polyethylene, polypropylene or ethylene/butene copolymer) are examples of useful flexible supports.

Any of the known methods can be used for the photographic processing of photosensitive materials made using this invention. The known processing baths can be used for processing. The processing temperature is normally selected between 18° C. and 50° C., but temperatures below 18° C. and above 50° C. can be used. Either development processing for the formation of a silver image (black-and-white processing) or color photographic processing as development processing for the formation of a dye image can be used according to the intended purpose.

More precisely, development processing can be carried out using the methods disclosed in *Research Disclosure,* Vol. 176, No. 17643, pages 28 and 29, and *Research Disclosure,* Vol. 187, No. 18716, page 651 from the left hand column to the right hand column.

This application is described by means of examples below, which, however, are not intended to restrict the scope of the invention.

EXAMPLE 1

An aqueous solution which contained gelatin and potassium bromide was maintained at 70° C. and agitated vigorously. An aqueous solution of silver nitrate and an aqueous solution of potassium bromide and potassium iodide were added thereto simultaneously, and a monodispersed octahedral silver iodobromide emulsion containing 2 mol % of silver iodide and of average grain size 0.80 μm was obtained.

The unwanted salts were removed from this emulsion using the flocculation method, after which the pH value was adjusted to 6.3 and the pAg value was adjusted to 8.4 and the emulsion was divided into 11 parts, each of which was chemically sensitized at 60° C. in such a way as to provide the optimum sensitivity with an exposure time of 1/100th of a second following the addition of sodium thiosulfate (3 mg/mol of silver halide) and the compounds shown in Table 1.

The stabilizing agent, film hardening agent and coating aid indicated below were added to each of the emulsions obtained in this way, and Samples 1 to 11 were obtained by coating these emulsions, together with a gelatin surface protecting layer, using the method of simultaneous extrusion onto polyethylene terephthalate film supports and drying the coated layers.

Stabilizinq Aqent:

4-Hydroxy-6-methyl-l,3,3a,7-tetraazaindene

Film Hardeninq Agent:

3,4-Dichloro-6-hydroxy-l,3,5-triazine sodium salt

Coating Aid:

Sodium dodecylbenzenesulfonate

The samples obtained were exposed through an optical wedge (1/100th of a second and 10 second exposures) using a sensitometer, after which they were developed for 30 seconds at 35° C. in automatic processor RD-III developer (made by Fuji Photo Film Co., Ltd.) and then fixed, washed and dried in the usual way and the photographic sensitivities were determined. The photographic sensitivity was represented as a relative value of the reciprocal of the exposure required to provide an optical density of fog+0.2, taking the sensitivity of Sample 1 exposed for 1/100th of a second to be 100.

TABLE 1

| Sample No. | Compound | Amount Added (g/mol AgX) | Relative Sensitivity 1/100th Sec. | Relative Sensitivity 10 Sec. |
|---|---|---|---|---|
| 1 | — | — | 100 | 65 |
| 2 | (1) | 0.065 | 178 | 148 |
| 3 | (2) | 0.080 | 181 | 150 |
| 4 | (3) | 0.080 | 175 | 140 |
| 5 | (7) | 0.080 | 180 | 152 |
| 6 | (16) | 0.100 | 172 | 141 |
| 7 | (22) | 0.100 | 160 | 132 |
| 8 | Comparative Compound (a) | 0.120 | 125 | 85 |
| 9 | Comparative Compound (b) | 0.100 | 138 | 108 |
| 10 | Comparative Compound (c) | 0.100 | 118 | 83 |
| 11 | Comparative Compound (d) | 0.100 | 125 | 90 |

Comparative Compound (a):
3,6-Dithia-1,8-octanediol (compound disclosed in U.S. Pat. No. 3,021,215)
Comparative Compound (b):
Bis(p-ethoxyphenyl)telluride (compound disclosed in JP-A-53-57817)
Comparative Compound (c):
Tributyltellurium iodide (compound disclosed in JP-A-53-57817)
Comparative Compound (d):
Bis-carboxymethyltelluride (compound disclosed in JP-A-53-57817)

It is clear from Table 1 that a remarkable increase in photographic sensitivity was obtained by using the compounds of this invention. The sensitivities achieved were higher than those obtained using the conventional thioether compound (Comparative Compound (a)) or telluroether compounds (Comparative Compounds (b), (c) and (d)).

Moreover, there was also a remarkable increase in photographic sensitivity with the 10 second exposures and a marked improvement in respect of the phenomenon known in the photographic industry as low brightness reciprocity law failure.

Furthermore, on exposing Samples 2, 9 and 11 for 1/100th of a second after storing for 3 days under conditions of 45° C., 75% relative humidity and then developing and processing in the same way as before, Sample 9 had a relative sensitivity of 104, a sensitivity reduction of 34, and Sample 11 had a relative sensitivity of 101, a sensitivity reduction of 24, but Sample 2 had a relative sensitivity of 164, a sensitivity reduction of only 14. Thus, the telluroether compounds of this invention have the advantage not only of providing higher sensitivities than the conventional tellurium compounds but also of markedly improving the materials in respect of the decrease of sensitivity on storage under conditions of high temperature and high humidity.

EXAMPLE 2

Silver Bromide Emulsions A to E were prepared by adding the compounds shown in Table 2 to aqueous solutions which contained gelatin and silver bromide which were being maintained at 60° C. and then adding simultaneously using the CDJ (controlled double jet) method in such a way as to maintain the pAg value at 8.3 an aqueous solution of silver nitrate and an aqueous solution of potassium bromide.

An electron microscope was used to determine the average grain size and the grain size distribution (represented by the variation coefficient, a value obtained by dividing the standard deviation by the average grain size, a small value indicating a narrow grain size distribution and a more monodispersed emulsion) of the silver bromide grains so obtained and the results obtained are shown in Table 2.

It is clear from Table 2 that the telluroether compounds of this invention provide silver halide grains which have good monodispersivity even when used in smaller quantities than Comparative Compounds (a) and (b). Furthermore, Comparative Compound (b) (tellurium compound) had to be dissolved in acetone for addition and this was disadvantageous in that the acetone coagulated the gelatin and tended to result in the aggregation of the grains themselves, but the compounds of this invention are soluble in lower alcohols such as methanol and, in many cases, in water and so there is little danger of coagulating the gelatin and this is a considerable advantage in practice.

TABLE 2

| Emulsion | Compound | Amount Added (mmol/mol AgX) | Average Grain Size (μm) | Variation Coefficient |
|---|---|---|---|---|
| A | — | — | 0.15 | |
| B | (1) | 0.4 | 0.62 | 0.065 |
| C | (2) | 0.3 | 0.60 | 0.078 |
| D | Comparative Compound (a) | 2.4 | 0.58 | 0.096 |
| E | Comparative Compound (b) | 1.2 | 0.54 (some aggregation of grains occurred) | 0.145 |

EXAMPLE 3

A silver iodobromide emulsion consisting of plate-like twinned crystal grains of average iodide content of 8 mol %, with a double structure of the high internal iodide content (iodide content of 24 mol % in a core and 2.7 mol % in a shell) with a core/shell ratio of $\frac{1}{3}$ (molar ratio of silver), a corresponding sphere diameter of 0.7 μm and a diameter/thickness ratio of 5.0 was prepared by adding hydrogen peroxide (0.05 mol/mol of silver) after using 3,6-dithia-1,8-octanediol (2 g/mol of silver) during the formation of the core part of the grains and then adding an aqueous silver nitrate solution and an aqueous solution of potassium bromide and potassium iodide using the double jet method to form the shell parts, after which chloroauric acid, potassium thiocyanate and sodium thiosulfate were added and the emulsion was heated to 60° C. for 45 minutes to carry out gold/sulfur sensitization.

The emulsion so obtained was divided into five parts and the compounds indicated in Table 3 were added after adding Spectrally Sensitizing Dye (S-1). Moreover, Coupler Dispersion (Cp-1, Oil-1, Oil-2), antifogging agent (1-(m-sulfophenyl)-5-mercaptotetrazole monosodium salt), stabilizer (4-hydroxy-6-methyl-1,3,3a,7-tetraazaindene), Film Hardening Agent (H-1) and coating aids (sodium p-dodecylbenzenesulfonate and sodium p-nonylphenoxypoly(ethyleneoxy)propanesulfonate) were added and Samples 12 to 16 were obtained by coating these emulsions, together with a gelatin protective layer, onto cellulose triacetate supports.

The samples obtained were exposed through an optical wedge (1/100th of a second) and color developed and processed in the way indicated below and the photographic characteristics were measured. The results obtained are shown in Table 3.

Moreover, the sensitivities shown in Table 3 are relative sensitivities as described in Example 1, obtained on this occasion by taking the sensitivity of Sample 12 to be 100.

| | |
|---|---|
| 1. Color Development | 2 min 45 sec (38° C.) |
| 2. Bleach | 6 min 30 sec |
| 3. Water Wash | 3 min 15 sec |
| 4. Fixing | 6 min 30 sec |
| 5. Water Wash | 3 min 15 sec |
| 6. Stabilization | 3 min 15 sec |

The compositions of the processing baths used in each process were as follows:

| | |
|---|---|
| Color Development Bath: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylaniline Sulfate | 4.5 g |
| Water to make | 1 liter |
| Bleach Bath: | |
| Ammonium Bromide | 160.0 g |
| Aqueous Ammonia (28 wt %) | 25.0 ml |
| Ethylenediaminetetraacetic Acid Sodium Iron Salt | 130.0 g |
| Glacial Acetic Acid | 14.0 ml |
| Water to make | 1 liter |
| Fixer Bath: | |
| Sodium Tetrapolyphosphate | 2.0 g |
| Sodium Sulfite | 4.0 g |
| Ammonium Thiosulfate (70 wt %) | 175.0 ml |
| Sodium Bisulfite | 4.6 g |
| Water to make | 1 liter |
| Stabilizer Bath: | |
| Formalin | 8.0 ml |
| Water to make | 1 liter |

Sensitizing Dye (S-1)

-continued

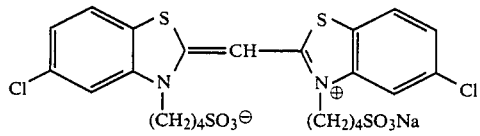

(Cp-1)

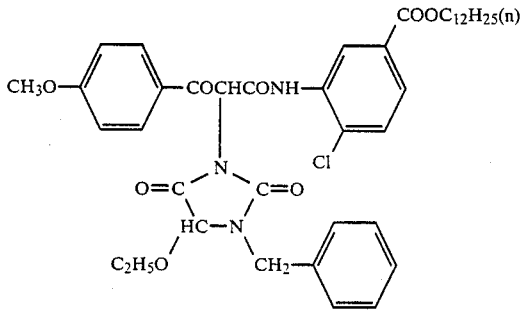

(Oil-1)
Tricresyl phosphate (Oil-2)
Dibutyl phthalate (H-1)

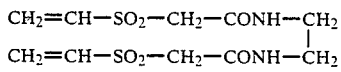

TABLE 3

| Sample No. | Compound | Amount Added (mmol/mol AgX) | Relative Sensitivity | Fog |
|---|---|---|---|---|
| 12 | — | — | 100 | 0.18 |
| 13 | (1) | 0.40 | 141 | 0.18 |
| 14 | (10) | 0.40 | 132 | 0.18 |
| 15 | (14) | 0.40 | 128 | 0.18 |
| 16 | Comparative Compound (b) | 0.86 | 118 | 0.20 |

It is clear from Table 3 that the compounds of this invention increase photographic sensitivity without increased fogging more effectively than the comparative compound.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion which contains at least one telluroether compound represented by the formula (I) indicated below:

$$L_1—Te—L_2 \quad (I)$$

where $L_1$ and $L_2$ each independently represents a substituted or unsubstituted aliphatic group, and at least one of $L_1$ or $L_2$ represents an aliphatic group which is substituted with at least one hydroxyl, group, mercapto group, amino group, ether group, selenoether group, thioether group, ammonium group, sulfonyl group, carbamoyl group, carbonamido group, sulfamoyl group, sulfonamido group, acyloxy group, sulfonyloxy group, ureido group, thioureido group, thioamido group, oxysulfonyl group, oxycarbonylamino group, sulfonic acid group or salt thereof, phosphoric acid or salt thereof, phosphoric ester group, sulfinic acid group or a salt thereof, phosphino group or heterocyclic group.

2. The silver halide photographic material of claim 1, wherein the aliphatic group represented by each of $L_1$ and $L_2$ is a linear chain or branched chain alkyl group, a linear chain or branched chain alkenyl group or a cycloalkyl group.

3. The silver halide photographic material of claim 2, wherein the alkyl group has from 1 to 30 carbon atoms, the alkenyl group has from 2 to 30 carbon atoms and the cycloalkyl group has a 3- to 12-membered ring.

4. The silver halide photographic material of claim 3, wherein the alkyl group contains from 1 to 20 carbon atoms, the alkenyl group contains from 2 to 20 carbon atoms and the cycloalkyl group has a 5- to 7-membered ring.

5. The silver halide photographic material of claim 2, wherein the aliphatic group is an alkyl group or an alkenyl group.

6. The silver halide photographic material of claim 5, wherein the aliphatic group is an alkyl group.

7. The silver halide photographic material of claim 1, wherein said substituent is selected from the group consisting of amino groups, ether groups, thioether groups, selenoether groups, ammonium groups, hydroxyl groups, mercapto groups, sulfonyl groups, carbamoyl groups, carbonamido groups, sulfamoyl groups, sulfonamido groups, ureido groups, thioureido groups, oxycarbonylamino groups, thioamido groups, sulfonic acid groups or salts thereof, sulfinic acid groups or salts thereof, phosphoric acid groups or salts thereof, phosphino groups and heterocyclic groups.

8. The silver halide photographic material of claim 7, wherein the substituent is selected from the group consisting of hydroxyl groups, amino groups, sulfonic acid groups and salts thereof and thioether groups.

9. The silver halide photographic material of claim 8, wherein the substituent is selected from hydroxyl groups.

10. The silver halide photographic material of claim 1, wherein the compound of formula (I) is added to the silver halide emulsion in at least one of the processes selected from the group consisting of precipitation and formation of silver halide grains, physical ripening, chemical ripening and immediately before coating.

11. The silver halide photographic material of claim 10, wherein the compound of formula (I) is added to the silver halide emulsion during the precipitation and formation of the silver halide grains, during physical ripening or during chemical ripening.

12. The silver halide photographic material of claim 1, wherein the silver halide emulsion comprises a monodispersion of silver halide grains wherein 95% of the grains are of a size for within ±60% of the number average grain size.

13. The silver halide photographic material of claim 12, wherein 95% of the grains are within ±40% of the number average grain size.

14. The silver halide photographic material of claim 1, wherein the compound of formula (I) is added during the formation of the silver halide grains and is added in an amount from 0.001 to 100 g per mol of silver halide.

15. The silver halide photographic material of claim 14, wherein the compound of formula (I) is added in an amount of from 0.003 to 30 g per mol of silver halide.

16. The silver halide photographic material of claim 1, wherein the compound of formula (I) is added prior to chemical ripening in an amount from 0.001 to 10 g per mol of silver halide.

17. The silver halide photographic material of claim 1, wherein the compound of formula (I) is added immediately prior to coating in an amount of from 0.001 to 10 g per mol of silver halide.

* * * * *